US007917070B2

(12) United States Patent
Shimizu et al.

(10) Patent No.: US 7,917,070 B2
(45) Date of Patent: Mar. 29, 2011

(54) INTERMEDIATE TRANSFER DEVICE AND IMAGE FORMING APPARATUS USING SAME

(75) Inventors: Misaki Shimizu, Komae (JP); Yukimichi Someya, Machida (JP)

(73) Assignee: Ricoh Company Limited, Tokyo (JP)

( * ) Notice: Subject to any disclaimer, the term of this patent is extended or adjusted under 35 U.S.C. 154(b) by 161 days.

(21) Appl. No.: 12/108,786

(22) Filed: Apr. 24, 2008

(65) Prior Publication Data

US 2008/0267674 A1 Oct. 30, 2008

(30) Foreign Application Priority Data

Apr. 26, 2007 (JP) ..... 2007-117629
Jul. 13, 2007 (JP) ..... 2007-184951

(51) Int. Cl.
*G03G 15/16* (2006.01)

(52) U.S. Cl. ..... 399/307

(58) Field of Classification Search ..... 399/307, 399/308

See application file for complete search history.

(56) References Cited

U.S. PATENT DOCUMENTS

| | | | | |
|---|---|---|---|---|
| 6,175,712 | B1 * | 1/2001 | Masuda et al. | 399/302 |
| 6,957,036 | B2 | 10/2005 | Kikuchi et al. | |
| 7,010,257 | B2 | 3/2006 | Someya et al. | |
| 7,031,648 | B2 | 4/2006 | Takashi et al. | |
| 7,127,202 | B2 | 10/2006 | Fujita et al. | |
| 7,139,520 | B2 | 11/2006 | Echigo et al. | |
| 7,177,580 | B2 | 2/2007 | Nakafuji et al. | |
| 7,233,762 | B2 | 6/2007 | Kunii et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,333,760 | B2 | 2/2008 | Baba et al. | |
| 7,359,666 | B2 | 4/2008 | Takashi et al. | |
| 2002/0064406 | A1 * | 5/2002 | Jia et al. | 399/327 |
| 2005/0158075 | A1 | 7/2005 | Echigo et al. | |
| 2005/0207801 | A1 * | 9/2005 | Kunii et al. | 399/307 |
| 2006/0013624 | A1 | 1/2006 | Kurotaka et al. | |
| 2006/0019082 | A1 | 1/2006 | Kikuchi et al. | |
| 2006/0088349 | A1 | 4/2006 | Someya et al. | |
| 2006/0120776 | A1 * | 6/2006 | Takashi et al. | 399/307 |
| 2006/0140689 | A1 | 6/2006 | Echigo et al. | |

FOREIGN PATENT DOCUMENTS

| | | |
|---|---|---|
| JP | 11-167295 | 6/1999 |
| JP | 2001-13798 | 1/2001 |
| JP | 2002-99159 | 4/2002 |
| JP | 3528371 | 3/2004 |
| JP | 3528571 | 3/2004 |
| JP | 2005-266304 | 9/2005 |

OTHER PUBLICATIONS

U.S. Appl. No. 12/186,906, filed Aug. 6, 2008, Someya, et al.

* cited by examiner

*Primary Examiner* — David M Gray
*Assistant Examiner* — Rodney Bonnette
(74) *Attorney, Agent, or Firm* — Oblon, Spivak, McClelland, Maier & Neustadt, L.L.P.

(57) ABSTRACT

An intermediate transfer device includes a secondary intermediate transfer member configured to transfer a toner image from an image bearing member via a primary intermediate transfer member, for transfer of the toner image onto a recording medium, a heating unit configured to heat the toner image on the secondary intermediate transfer member, and a deformation unit configured to deform the toner image on the secondary intermediate transfer member by application of pressure. A heating region in which the heating unit heats the toner image has a larger area than a deformation region in which the deformation unit deforms the toner image. The deformation region is provided on a downstream side from the heating region relative to a direction of movement of the secondary intermediate transfer member.

15 Claims, 13 Drawing Sheets

INTERMEDIATE TRANSFER DEVICE AND IMAGE FORMING APPARATUS USING SAME

CROSS-REFERENCE TO RELATED APPLICATIONS

This document claims priority and contains subject matter related to Japanese Patent Applications Nos. 2007-117629 and 2007-184951, filed on Apr. 26, 2007 and Jul. 13, 2007, respectively, the entire contents of each of which are incorporated herein by reference.

BACKGROUND

1. Field of the Invention

The present invention relates to an intermediate transfer device for use in electrophotography, and more particularly, an image forming apparatus, such as a copier, a facsimile, a printer, or a multifunctional peripheral, using the intermediate transfer device.

2. Description of the Background

In a typical image forming apparatus, a toner image is fixed on a recording medium, such as paper, by application of heat and pressure from a fixing device. Since the surface of the recording medium has microscopic concavities and convexities due to the presence of fibers, the toner image deforms along the microscopic concavities and convexities when fixed thereon. The degree of deformation of the toner image varies by location on the surface, but the toner image on convex portions of the surface largely deforms.

For the above reason, a toner image fixed on a recording medium having a rough surface can appear grainy. In particular, a toner image formed on a concave portion deforms much less when fixed thereon because the toner image is not in contact with a pressing member or a pressing force applied to the toner image from the pressing member is small. Therefore, there is a difference in surface texture between toner images fixed on convex portions and concave portions of the surface of the recording medium, resulting in uneven gloss in the fixed toner image.

To solve the above-described problem, various image forming apparatuses employing an intermediate transfer member have been proposed.

Japanese Patent No. (hereinafter JP) 3528371 discloses an image forming apparatus including an endless-belt-like image bearing member, a rotatable endless-belt-like intermediate transfer member in contact with the image bearing member, and a heating roller configured to heat a toner image transferred onto the intermediate transfer member to a temperature higher than the melting temperature of the toner. The image forming apparatus further includes a support roller configured to support the intermediate transfer member and a pressing roller configured to press the intermediate transfer member with a transfer member therebetween, both provided on a downstream side from the heating roller relative to a rotation direction of the intermediate transfer member, so that the toner image on the intermediate transfer member is transfixed on the transfer member.

However, there is still a problem in that the toner image deforms to a greater or lesser extent when fixed on the transfer member. This is because the toner image has been previously deformed on the intermediate transfer member when heated to a temperature higher than the melting temperature of the toner, and furthermore, as noted above, the toner image is pressed against microscopic concavities and convexities formed on the surface of the transfer member due to the presence of fibers at a nip formed between the inter mediate transfer member and the pressing roller. A toner image fixed on a convex portion largely deforms, in other words, a toner image fixed on a convex portion has a relatively large area. By contrast, a toner image fixed on a concave portion deforms less, in other words, a toner image fixed on a concave portion has a relatively small area. As a result, low-quality images of uneven granularity and glossiness are produced.

Unexamined Japanese Patent Application Publication No. (hereinafter JP-A) 2001-13798 discloses an image forming apparatus in which a toner image formed on an image bearing member is transferred onto an intermediate transfer member, wherein a plane heater provided on an inner side of the intermediate transfer member heats the toner image with the intermediate transfer member therebetween, so that at least part of toner particles included in the toner image are softened and melted so as to be integrated before the toner image passes through a nip at which a pressing roller presses a heating roller with the intermediate transfer member therebetween. The integrated toner image is then transfixed onto a recording medium at the nip.

Since the toner image has been previously heated and deformed, the toner image has a low viscosity, and therefore the fixed toner image on a recording medium has a height of from 40 to 80% of the unfixed toner image. Consequently, the area of the fixed toner image varies depending on microscopic concavities and convexities formed on the surface of the recording medium, resulting in poor image quality.

JP-A2005-266304 discloses a transfixing device including an image bearing member to bear a toner image and an integrating means for integrating toner particles included in the toner image, wherein an unfixed integrated toner image is transfixed onto a recording medium at a transfixing area. The transfixing device further includes an adhering means for giving an adherence property to a surface of the integrated toner image which contacts the recording medium, provided on an upstream side from the transfixing area relative to a conveyance direction of the recording medium. The adhering means provides adherence by using radiant heat, applying a fixing auxiliary agent, etc.

In particular, the toner image on an intermediate transfer member is melted by heating a toner integrating roller provided facing the intermediate transfer member. Since the toner image is more likely to adhere to a member having a higher temperature, there is a problem in that the toner image easily adheres to the heated toner integrating roller.

FIG. 1 is a schematic view illustrating a process of deformation of a toner image T in a background-art intermediate transfer device 200.

FIG. 2 is a schematic view for explaining deterioration of the toner image T, transferred using the background-art intermediate transfer device 200, when fixed on a recording medium P having a rough surface.

The toner image T is required to have a desired image density after being fixed on the recording medium P. As the surface roughness of the recording medium P increases, the toner image T needs to include a larger amount of toner particles to obtain the desired image density. This is because toner particles included in the toner image T tend to get into concave portions of the surface of the recording medium P when transferred thereon. For example, a 100% solid image may have a smaller toner area ratio, which is a ratio of an area to which toner particles are adhered, after transferred onto the recording medium P.

When the toner image T is transferred onto the recording medium P having a rough surface by the background-art fixing device 200 and fixed thereon by a fixing device, the toner area ratio of the toner image T slightly increases after being fixed, as illustrated in FIGS. 1(*a*) and 1(*b*). However, only toner particles transferred onto convex portions of the recording medium P receive pressure from the fixing device to be deformed, as illustrated in FIG. 2, resulting in a smaller deformation of the toner image T. Therefore, the toner image T needs to include a larger amount of toner particles to obtain the desired image density on the recording medium P having a rough surface.

For example, when a 100% solid image including toner particles in an amount of 0.4 mg/cm$^2$ is transferred onto a recording medium having a high smoothness (i.e., Rz=2 μm), with toner particles having an average particle diameter of 6 μm, the transferred image has a toner area ratio of 90%, while the transferred image has a toner area ratio of 80% when transferred onto a recording medium having a low smoothness (i.e., Rz=50 μm). When the transferred image is fixed on the above-described recording media each having a high and a low smoothness, the fixed solid image has a toner area ratio of 97% and 82%, respectively. The recording media having a low smoothness needs toner particles in an amount of 0.5 mg/cm$^2$ to obtain a desired image density.

When the toner image T on an intermediate transfer member 201 is previously deformed before transferred onto the recording medium P, the toner image T transferred onto the recording medium P has a smooth surface that results from a smooth surface of the intermediate transfer member 201, as illustrated in FIG. 1(*c*). Although the transferred toner image T has a smooth surface, the toner image T fixed on the recording medium P has a rough surface, as illustrated in FIG. 1(*d*), resulting in uneven glossiness of the toner image.

An image forming apparatus mounting the above-described intermediate transfer device typically employs a heat fixing method in which a toner image is fixed on a recording medium by application of heat and pressure. The fixing performance of the heat fixing method largely depends on the nature of the surface of the recording medium. When the recording medium has a rough surface, the toner image needs to receive a higher temperature or a greater pressure at a transfixing area to be satisfactorily fixed on the recording medium.

As the temperature of the toner image increases, that of an intermediate transfer member also increases. Further, the heat may transfer to an image bearing member, and therefore the temperature of the image bearing member also increases. As a result, the temperatures of other devices and members provided adjacent to the image bearing member also increase. Consequently, a toner contained in a developing device or a cleaning device may be aggregated on or adhered to the device, which is undesirable. Moreover, when a greater pressure is applied at a transfixing area, the durability of the image bearing member may deteriorate.

SUMMARY

Accordingly, the present invention provides an intermediate transfer device which can produce high quality images regardless of the surface roughness of a recording medium.

In addition, the present invention also provides an image forming apparatus which is energy-efficient and inexpensive, and has good durability.

These and other features and advantages of the present invention, either individually or in combinations thereof, as hereinafter will become more readily apparent, can be attained by example embodiments described below.

One example embodiment provides an intermediate transfer device including a secondary intermediate transfer member configured to transfer a toner image from an image bearing member via a primary intermediate transfer member for transfer of the toner image onto a recording medium, a heating unit configured to heat the toner image on the secondary intermediate transfer member, and a deformation unit configured to deform the toner image on the secondary intermediate transfer member by application of pressure. A heating region in which the heating unit heats the toner image has a larger area than a deformation region in which the deformation unit deforms the toner image. The deformation region is provided on a downstream side from the heating region relative to a direction of movement of the secondary intermediate transfer member.

In another example embodiment, the secondary intermediate transfer member includes a rotatable member including the heating unit. The rotatable member is provided facing the deformation unit and has a larger diameter than the deformation unit.

Yet another example embodiment provides an image forming apparatus including an image bearing member configured to bear an electrostatic latent image, an electrostatic latent image forming device configured to form the electrostatic latent image on the image bearing member, a developing device configured to develop the electrostatic latent image with a toner to form a toner image, an intermediate transfer device, and a fixing device configured to fix the toner image on the recording medium. The intermediate transfer device includes an intermediate transfer member configured to transfer the toner image from the image bearing member for transfer of the toner image onto a recording medium, a heating unit configured to heat the toner image on the intermediate transfer member, and a deformation unit configured to deform the toner image on the intermediate transfer member by application of pressure. A heating region in which the heating unit heats the toner image has a larger area than a deformation region in which the deformation unit deforms the toner image. The deformation region is provided on a downstream side from the heating region relative to a direction of movement of the intermediate transfer member. The toner image may include a plurality of different-color toner images superimposed on one another on the intermediate transfer member.

Yet another example embodiment provides an image forming apparatus including an image bearing member configured to bear an electrostatic latent image, an electrostatic latent image forming device configured to form the electrostatic latent image on the image bearing member, a developing device configured to develop the electrostatic latent image with a toner to form a toner image, a primary intermediate transfer device including a primary intermediate transfer member configured to primarily transfer the toner image from the image bearing member, a secondary intermediate transfer device, and a fixing device configured to fix the toner image on the recording medium. The secondary intermediate transfer device includes a secondary intermediate transfer member configured to secondarily transfer the toner image from the primary intermediate transfer member for tertiary transfer of the toner image onto a recording medium, a heating unit configured to heat the toner image on the secondary intermediate transfer member, and a deformation unit configured to deform the toner image on the secondary intermediate transfer member by application of pressure. A heating region in which the heating unit heats the toner image has a larger area than a deformation region in which the deformation unit deforms the toner image. The deformation region is provided on a downstream side from the heating region relative to a direction of movement of the secondary intermediate transfer member. The toner image may include a plurality of different-color toner images superimposed on one another on the primary intermediate transfer member.

Yet another example embodiment provides an intermediate transfer device including an intermediate transfer member configured to transfer a toner image from an image bearing member for transfer of the toner image onto a recording medium, a heating unit configured to heat and soften the toner image, and a deformation unit configured to deform the heated and softened toner image on the intermediate transfer member. The heating unit is provided on a path of movement of the intermediate transfer member.

Yet another example embodiment provides an image forming apparatus including an image forming unit configured to form a toner image, and an intermediate transfer device including an intermediate transfer member configured to transfer the toner image from an image bearing member for transfer of the toner image onto a recording medium, a heating unit configured to heat and soften the toner image, and a deformation unit configured to deform the heated and softened toner image on the intermediate transfer member. The heating unit is provided on a path of movement of the intermediate transfer member.

Additional features and advantages of the present invention will be more fully apparent from the following detailed description of example embodiments, the accompanying drawings and the associated claims.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DETAILED DESCRIPTION

Figure 1:
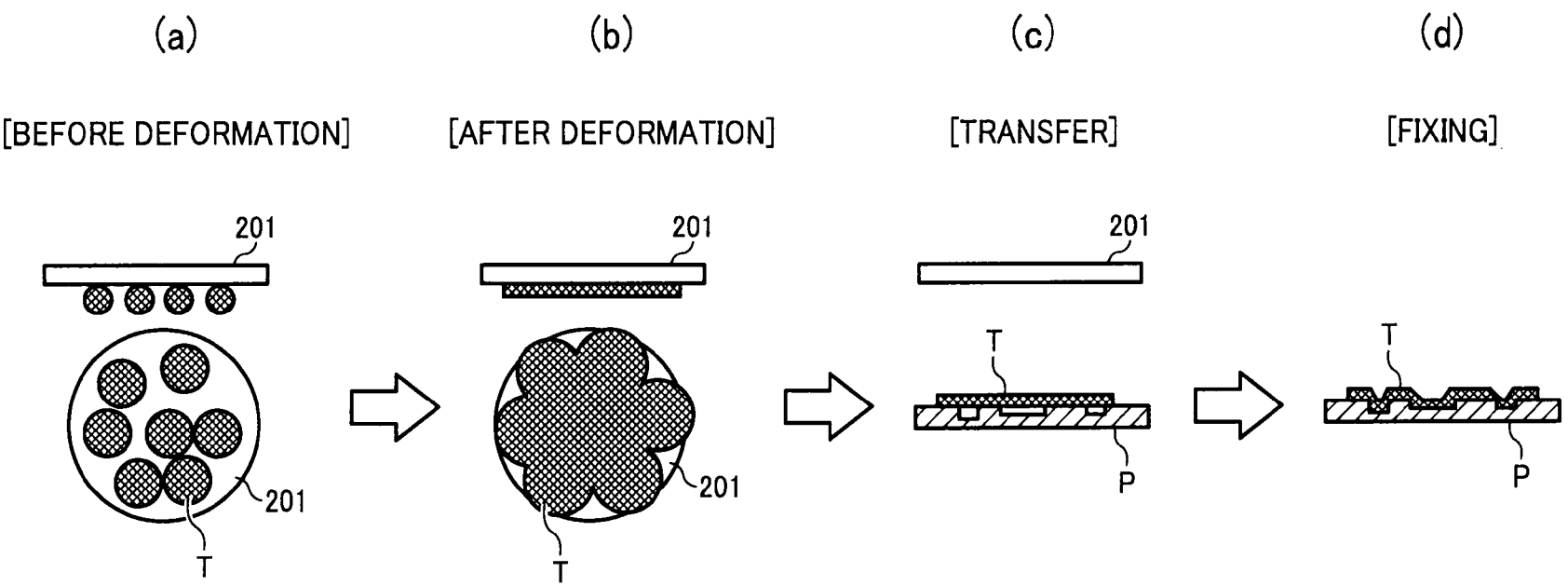
FIG. 1 BACKGROUND ART
FIG. 1 is a schematic view illustrating a process of deformation of a toner image T in a background-art intermediate transfer device 200.
Figure 2:
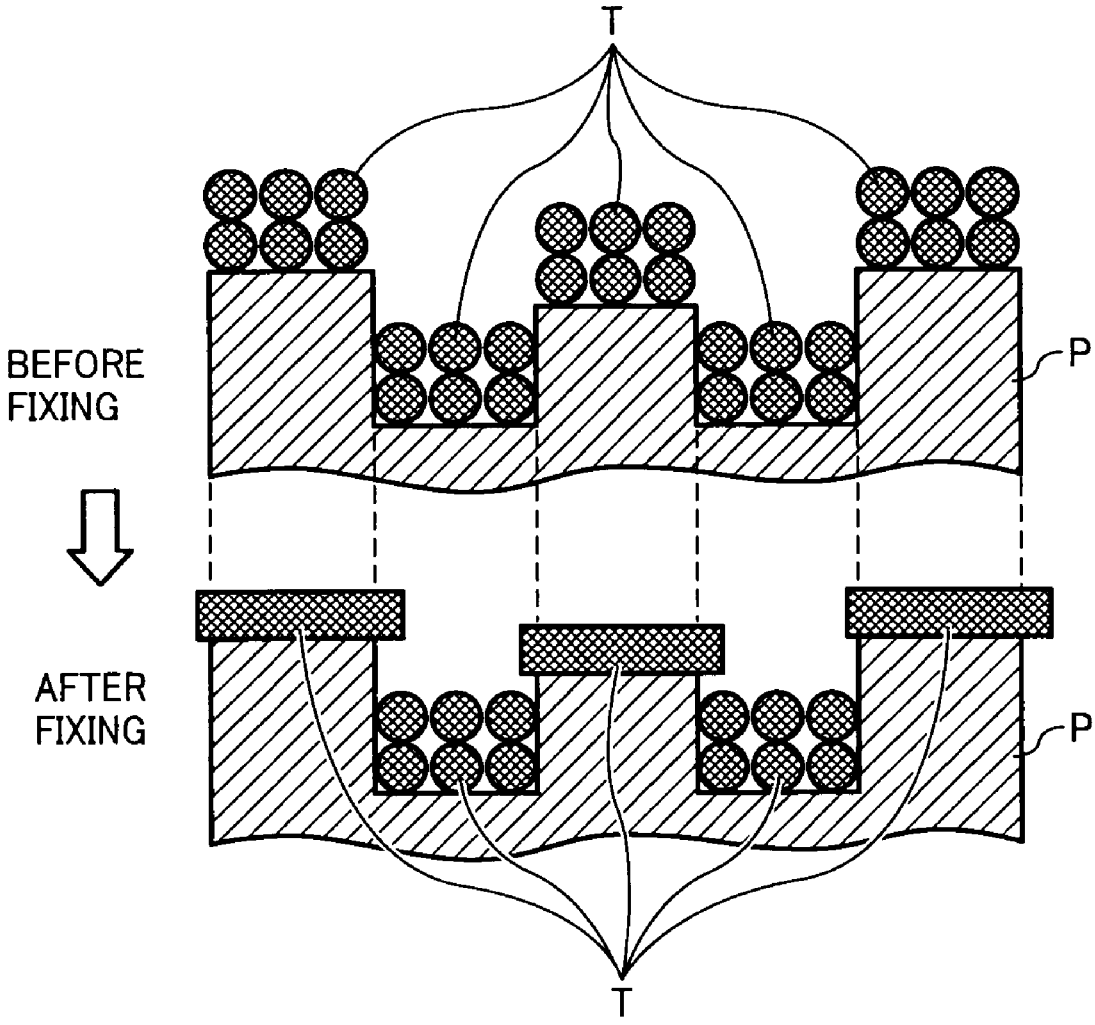
FIG. 2 BACKGROUND ART
FIG. 2 is a schematic view for explaining image deterioration of the toner image T, transferred using the background-art intermediate transfer device 200, when fixed on a recording medium P having a rough surface.

Example embodiments will now be described in detail referring to the drawings, wherein like reference numerals designate identical or corresponding parts throughout the several views thereof.

Figure 3:
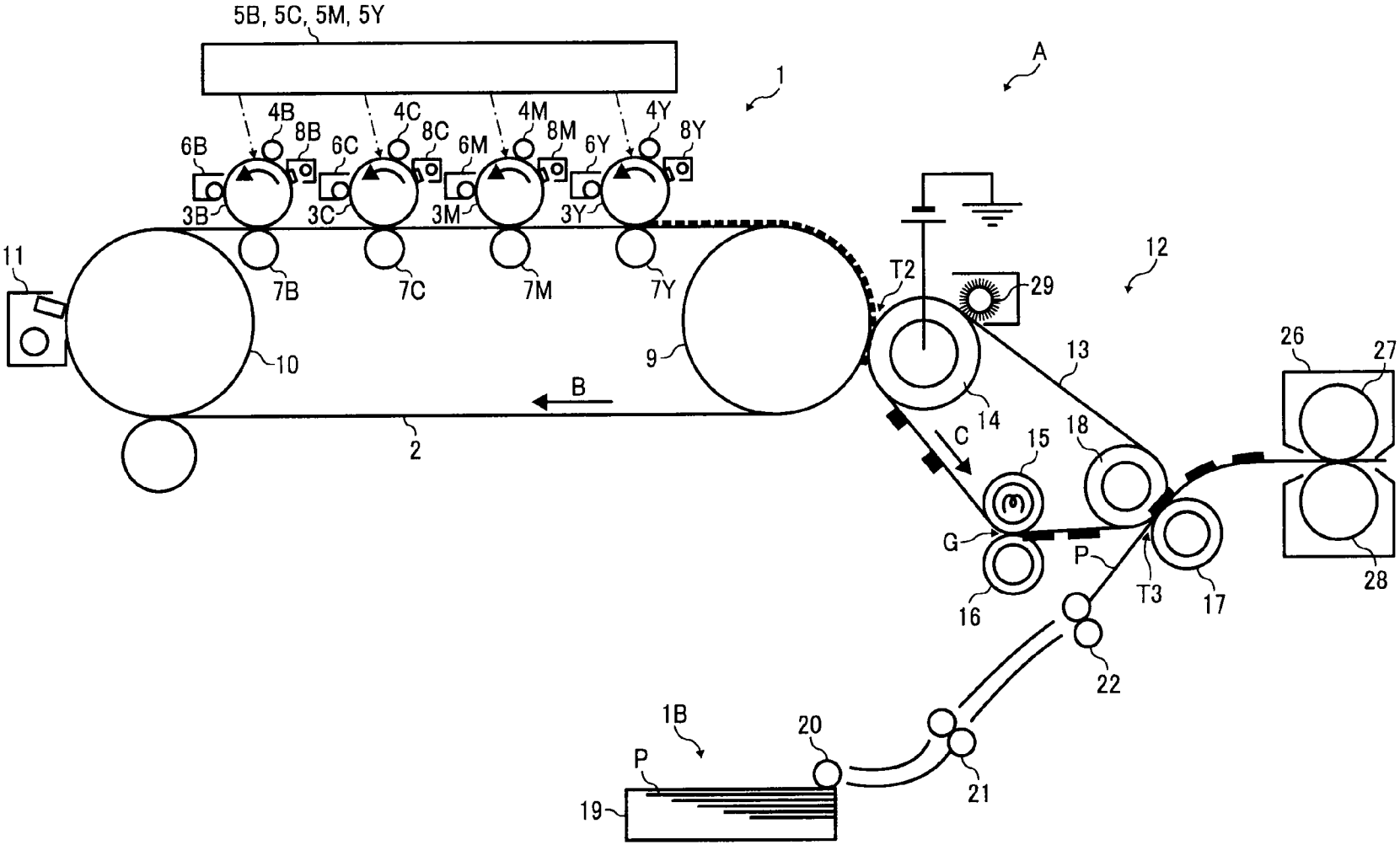
FIG. 3 is a schematic view illustrating one example embodiment of an image forming apparatus, which is a tandem color copier, employing an intermediate transfer device according to example embodiments.
Figure 4:
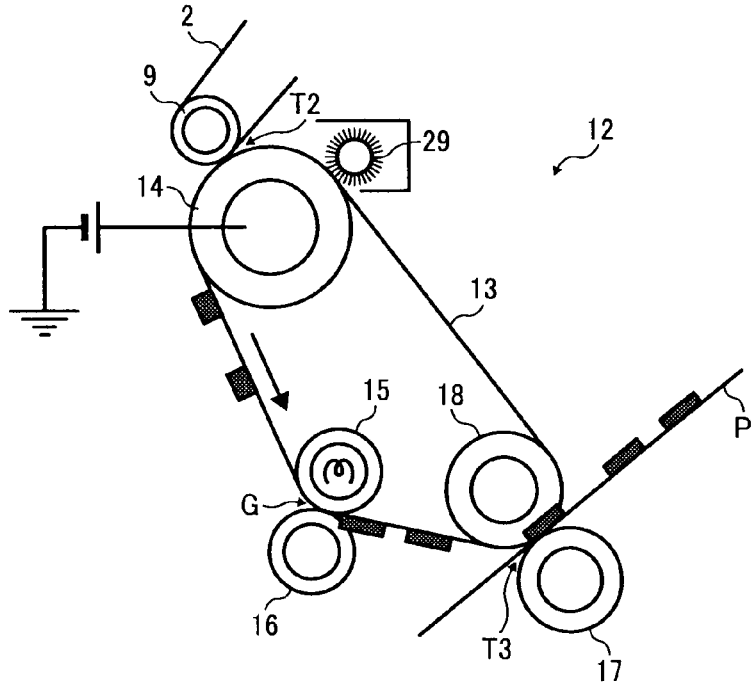
FIG. 4 is a schematic view illustrating an intermediate transfer device according to a first example embodiment.
Figure 5:
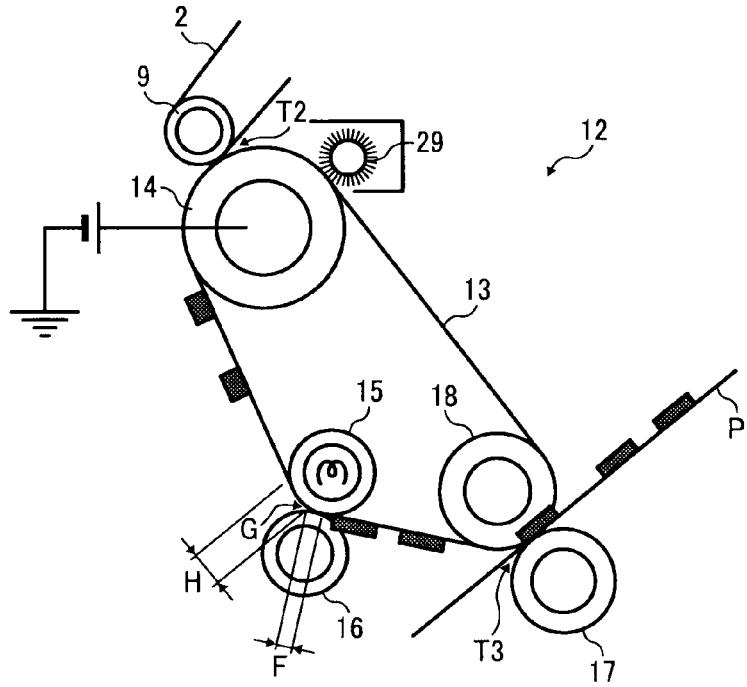
FIG. 5 is a schematic view showing a heating region and a deformation region in the intermediate transfer device according to the first example embodiment illustrated in FIG. 4.

FIG. 3 is a schematic view illustrating one example embodiment of an image forming apparatus, which is a tandem color copier, employing an intermediate transfer device according to example embodiments. FIG. 4 is a schematic view illustrating an intermediate transfer device according to a first example embodiment. FIG. 5 is a schematic view showing a heating region and a deformation region in the intermediate transfer device according to the first example embodiment illustrated in FIG. 4.

First, a structure of a tandem color printer A illustrated in FIG. 3 will be described.

The tandem color printer A illustrated in FIG. 3 includes an image forming part 1 in the center of a main body, an intermediate transfer device 12 serving as a secondary intermediate transfer device, a paper feed part 1B including a paper feed cassette 19 to feed a recording medium P, and a conveyance part including a paper feed roller 20, a pair of conveyance rollers 21, and a pair of registration rollers 22 to feed and convey the recording medium P from the paper feed part 1B.

The image forming part 1 includes an intermediate transfer belt 2 serving as a primary intermediate transfer member, having a transfer surface stretched in a horizontal direction. The intermediate transfer belt 2 is tightly stretched by a driving roller 9 and a driven roller 10, and is rotatable in a direction indicated by an arrow B. Drum-shaped photoconductors (i.e., image bearing members) 3Y, 3M, 3C, and 3B are arranged at specific intervals along a direction of movement of the intermediate transfer belt 2.

Toner images of yellow, magenta, cyan, and black, which are complementary colors of color separation colors, are formed on the drum-shaped photoconductors 3Y, 3M, 3C, and 3B (hereinafter collectively referred to as the photoconductors 3), respectively.

The photoconductors 3 are rotatable in the same direction, i.e., a counterclockwise direction. Charging devices 4Y, 4M, 4C, and 4B (hereinafter collectively "charging devices 4"), writing devices 5Y, 5M, 5C, and 5B (hereinafter collectively "writing devices 5"), developing devices 6Y, 6M, 6C, and 6B (hereinafter collectively "developing devices 6"), primary transfer rollers 7Y, 7M, 7C, and 7B (hereinafter collectively "primary transfer rollers 7"), and cleaning devices 8Y, 8M, 8C, and 8B (hereinafter collectively "cleaning devices 8") are provided around each photoconductor 3, respectively.

Each developing device 6 contains a toner having a color corresponding to a color of a latent image to be developed. A belt cleaning device 11 to clean the surface of the intermediate transfer belt 2 is provided so as to face the driven roller 10.

The intermediate transfer device 12 serving as a secondary intermediate transfer device is provided facing the driving roller 9. A secondary transfer roller 14 is provided so that a secondary transfer area T2 is formed between the intermediate transfer belt 2 and a secondary intermediate transfer belt 13 serving as a secondary intermediate transfer member. A voltage is applied to the secondary transfer roller 14 so that an electric field is formed between the secondary transfer roller 14 and the driving roller 9 to transfer a toner image.

The secondary intermediate transfer belt 13 is tightly stretched with the secondary transfer roller 14, a heating roller 15, and a tertiary transfer roller 18, and is rotatable in a direction indicated by an arrow C. A cleaning device 29 is provided in the vicinity of the secondary intermediate transfer belt 13 so as to face the secondary transfer roller 14.

A pressing roller 17 is provided so as to face the tertiary transfer roller 18 with the secondary intermediate transfer belt 13 therebetween. A pressing member, not shown, presses the pressing roller 17 against the tertiary transfer roller 18 to form a tertiary transfer area T3, at which a toner image is transferred onto the recording medium P, therebetween.

A deformation roller 16 to deform a toner image is provided so as to face and press the heating roller 15 with the secondary intermediate transfer belt 13 therebetween. A pressing member, not shown, presses the deformation roller 16 against the heating roller 15 to form a toner deformation area G therebetween.

Referring to FIG. 5, a heating region H formed by the heating roller 15 corresponds to a deformation region F formed by the deformation roller 16, or spreads from an upstream side from the deformation region F. Since the heating region H is provided on an upstream side from the deformation region F, a toner image is melted before entering the toner deformation area G, resulting in easy deformation of the toner image. When the heating region H has a larger area than the deformation region F, the toner may receive a larger amount of heat, resulting in easy melting of the toner image.

In the tertiary transfer area T3, the pressing roller 17 presses the tertiary transfer roller 18 with a pressing force of from 2 to 5 kgf/cm$^2$. In the toner deformation area G, the deformation roller 16 presses the heating roller 15 with a pressing force of from 0.5 to 3 kgf/cm$^2$. In the toner deformation area G, a toner image is deformed by application of heat and pressure, and therefore the pressing force may be reduced compared to a case in which a toner image is deformed by application of pressure only.

The recording medium P is fed from the paper feed cassette 19 and conveyed to the tertiary transfer area T3 by the paper feed roller 20, the pair of conveyance rollers 21, and the pair of registration rollers 22. The recording medium P is then conveyed to a fixing device 26. The fixing device 26 includes a fixing roller 27.

The fixing roller 27 includes a halogen heater, not shown. A pressing roller 28 is provided so as to face and press the fixing roller 27. The fixing roller 27 is controlled to have a predetermined or desired temperature so as to apply heat and pressure to the recording medium P where the pressing roller 28 presses the fixing roller 27.

The fixing roller 27 includes a metallic cored bar and an elastic layer, such as a layer including a silicone rubber having a thickness of from 0.1 to 0.5 mm. Furthermore, the fixing roller 27 includes a surface layer including a fluorocarbon resin, or a release agent such as a silicone oil is applied to the surface of the fixing roller 27, to improve releasability of the fixing roller 27. For example, a PFA tube having a thickness of 10 μm may be used for the surface layer, so that the surface layer has a low surface hardness.

Although the elastic layer including a silicone rubber has a low hardness, a combination with a thin layer including a fluorocarbon resin is preferable, from the viewpoint of improving durability. The term "hardness" here means the "microhardness". For example, the layer preferably has a universal hardness of 1 N/cm$^2$ or less at an indentation depth of 20 μm, corresponding to the surface roughness of a recording medium, at working temperatures, so that a thin toner layer precisely follows microscopic concavities and convexities of a recording medium.

Next, operation of the tandem color copier A will be described.

At a time the tandem color copier A starts a full-color image forming operation, the surface of the photoconductor 3Y is evenly charged by the charging device 4Y. The charged surface of the photoconductor 3Y is irradiated with a light beam emitted from the writing device 5Y, based on image information transmitted from an image reading part, thereby forming an electrostatic latent image corresponding to a yellow image.

The electrostatic latent image thus formed is developed with a yellow toner contained in the developing device 6Y to form a yellow toner image. The yellow toner image is primarily transferred onto the intermediate transfer belt 2 by the primary transfer roller 7Y to which a predetermined bias is applied.

Similarly, magenta, cyan, and black toner images are formed on the photo conductors 3M, 3C, and 3B, respectively. Each toner image is successively transferred onto the intermediate transfer belt 2 and superimposed on one another, in a process called primary transfer.

Residual toner particles remaining on the photoconductors 3 after the toner images are primarily transferred therefrom are removed by the cleaning devices 8. Subsequently, each of the photoconductors 3 is decharged by a decharging unit, not shown, so as to prepare for the next image forming operation.

A composite toner image (hereinafter simply referred to as the toner image), in which toner images of each color are superimposed on one another and primarily transferred onto the intermediate transfer belt 2, is then secondarily transferred onto the secondary intermediate transfer belt 13 at the secondary transfer area T2 by an electrostatic force generated due to a bias (such as an alternating current overlapped with a pulse) applied from a secondary bias applying device, not shown, to a gap between the driving roller 9 and the secondary transfer roller 14.

The toner image transferred onto the secondary intermediate transfer belt 13 is conveyed to the toner deformation area G formed between the heating roller 15 and the deformation roller 16. The heating roller 15 is controlled to have a predetermined temperature.

The toner image is heated by the heating roller 15 and deformed by the deformation roller 16. As a result, the toner image has a larger toner area ratio. Subsequently, the toner image is conveyed to the tertiary transfer area T3 formed between the pressing roller 17 and the tertiary transfer roller 18.

The recording medium P is fed from the paper feed cassette 19 by rotating the paper feed roller 20 in synchronization with entry of the toner image into a nip of the tertiary transfer area T3.

The recording medium P is conveyed by the pair of conveyance rollers 21 to the pair of registration rollers 22 and stopped thereby. By striking the leading edge of the recoding medium P against the pair of registration rollers 22, a skew may be corrected. Subsequently, the recording medium P is timely fed to the tertiary transfer area T3 so as to meet the tip of the toner image on the secondary intermediate transfer belt 13.

The toner image deformed in the toner deformation area G contacts the recording medium P with pressure at the tertiary transfer area T3 while being conveyed. The recording medium P onto which the toner image is transferred is conveyed to the fixing device 26, and discharged to a discharge tray, not shown.

The secondary intermediate transfer belt 13 may have a double-layered structure, including an inner substrate layer including a polyimide resin and an outer surface layer with elasticity including a silicone rubber having a thickness of from 0.05 to 0.5 mm, for example.

Since the secondary intermediate transfer belt 13 is heated from the backside thereof, the heating efficiency increases as the layers become thinner as life and durability thereof deteriorate.

Providing the surface layer with elasticity helps the deformed toner image to precisely follow the surface roughness of the recording medium P when transferred thereon at the tertiary transfer area T3, resulting in high transfer performance.

Of course, the toner image can be transferred onto a recording medium having a rough surface when the pressing force in the transfer area T3 is increased or the secondary intermediate transfer belt 13 is heated to soften the toner image. However, the larger pressing force may degrade the durability of the members and the heating may waste a large amount of energy. Furthermore, a heat of the secondary intermediate transfer belt 13 may be transmitted to the intermediate transfer belt 2 and the image forming part 1, resulting in occurrence of image distortion and toner blocking.

For the above reasons, the surface layer preferably includes a member capable of conforming to the surface roughness of the recording medium P. An ability of the member to conform to the surface roughness of the recording medium P can be represented by the surface hardness. The universal hardness, which is a microscopic hardness, is suitable for representing the surface hardness, while a typical surface hardness such as JIS hardness is unsuitable because the measurement area is larger than intervals of fibers of the recording medium P. The surface layer of the secondary intermediate transfer belt 13, which contacts the recording medium P, preferably has a surface hardness of HU 1.0 $N/mm^2$ or less at an indentation depth of 20 μm.

The surface layer of the secondary intermediate transfer belt 13 may also be formed using a tube having a thickness of from 5 to 20 μm including a fluorocarbon resin such as PFA (tetrafluoroethylene-perfluoroalkyl vinyl ether copolymer) and PTFE (tetrafluoroethylene copolymer), to provide stable separability and prevent deterioration thereof.

The deformation roller 16 includes a metallic cored bar, the surface of which is covered with a layer including a fluorocarbon resin such as PFA (tetrafluoroethylene-perfluoroalkyl vinyl ether copolymer) and PTFE (tetrafluoroethylene copolymer).

Referring to FIG. 5, the secondary intermediate transfer belt 13 contacts the heating roller 15 so as to form the heating region H in the intermediate transfer device 12. The heating roller 15 heats the toner image with the secondary intermediate transfer belt 13 therebetween. Subsequently, the toner image is deformed by application of heat and pressure in the deformation region F formed by the heating roller 15 and the deformation roller 16.

The heating region H preferably has an area larger enough to transmit heat from the heating roller 15 to the surface of the secondary intermediate transfer belt 13. Thereby, the toner image can be heated to a softening temperature thereof so as to be satisfactorily and effectively deformed.

When the heating region H is wider than the deformation region F, the toner image can receive a larger amount of heat. As a result, the toner image is satisfactorily softened to deform. A surface of the toner image contacting the secondary intermediate transfer belt 13 has a higher temperature than another surface thereof contacting the deformation roller 16.

Therefore, the toner image has a larger adherence to the secondary intermediate transfer belt 13 compared to the deformation roller 16, when pressure is applied to the toner image in the toner deformation area G. In other words, the toner image is prevented from adhering to the deformation roller 16 in the toner deformation area G.

The toner image passed through the toner deformation area G is conveyed to the tertiary transfer area T3 so that the toner image is transferred onto the recording medium P by contacting the recording medium P with pressure. Since the toner image is previously softened at an upstream side from the tertiary transfer area T3 by application of heat, there is an advantage that the toner image can be easily transferred onto the recording medium P.

It is advantageous to shorten a moving time of the toner image from the toner deformation area G to the tertiary transfer area T3 so that the toner image radiate less heat. Accordingly, the toner image can be much more easily transferred onto the recording medium P.

In the first example embodiment, the toner image is previously heated and softened before being deformed in the toner deformation area G. Therefore, pressure is evenly applied to the toner image in the toner deformation area G, resulting in stable deformation of the toner image. Since the toner image is previously stably deformed before being transferred onto the recording medium P, the resultant image is stably formed regardless of the surface roughness of the recording medium P.

In the first example embodiment, the secondary intermediate transfer belt 13 has a low surface hardness so as to improve transfer efficiency in the tertiary transfer area T3. Accordingly, the deformation roller 16 has a higher surface hardness than the secondary intermediate transfer belt 13 so that the toner image is much more deformed in the toner deformation area G. As a result, the resultant image has a large toner area ratio with fewer toner particles.

Although the intermediate transfer device according to the first example embodiment includes the heating roller 15, alternatively, an intermediate transfer device according to example embodiments may include an induction heating coil (hereinafter referred to as an IH coil) so that the secondary intermediate transfer belt 13 generates heat by itself.

Figure 6:
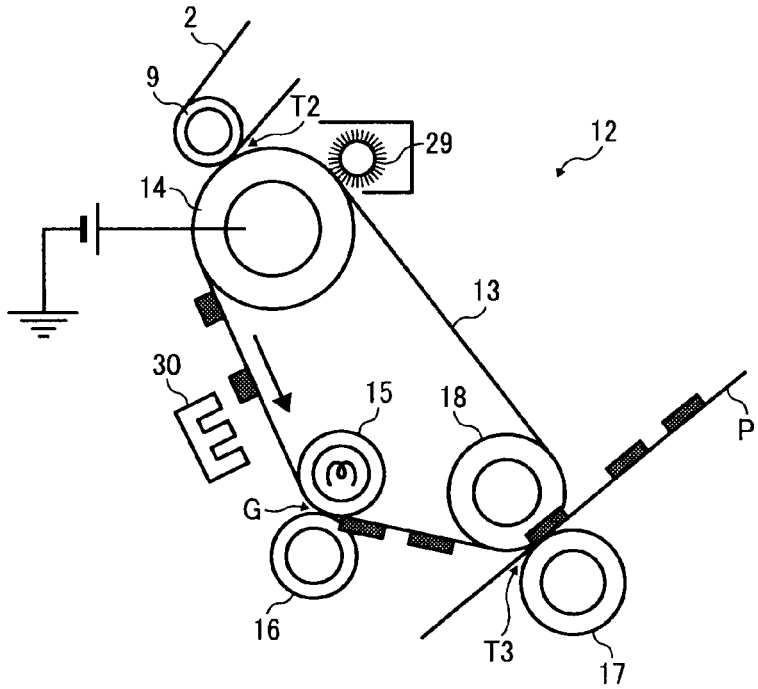
FIG. 6 is a schematic view illustrating an intermediate transfer device according to a second example embodiment.
Figure 7:
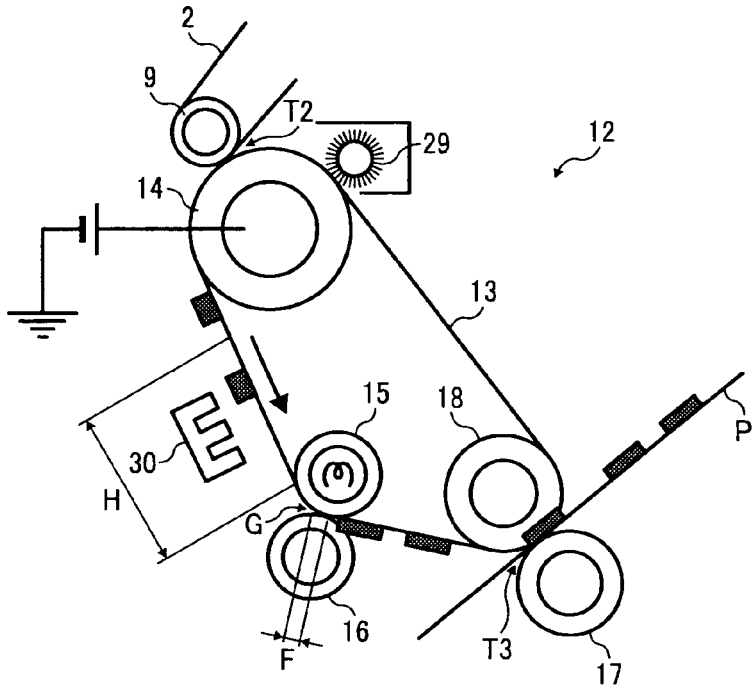
FIG. 7 is a schematic view showing a heating region and a deformation region in the intermediate transfer device according to the second example embodiment illustrated in FIG. 6.

FIG. 6 is a schematic view illustrating an intermediate transfer device according to a second example embodiment. FIG. 7 is a schematic view showing a heating region and a deformation region in the intermediate transfer device according to the second example embodiment illustrated in FIG. 6.

Referring to FIG. 6, the intermediate transfer device 12 serving as a secondary intermediate transfer device is provided so as to face the driving roller 9. The secondary transfer roller 14 is provided so that the secondary transfer area T2 is formed between the intermediate transfer belt 2 and the secondary intermediate transfer belt 13.

A voltage is applied to the secondary transfer roller 14 so that an electric field is formed between the secondary transfer roller 14 and the driving roller 9 to transfer a toner image. The roller 15, serving as a heating roller in the first example embodiment, serves as a support roller to support the secondary intermediate transfer belt 13 in the second example embodiment. An IH coil 30 is provided on an upstream side from the rollers 15 and 16 to enable the secondary intermediate transfer belt 13 to generate heat by itself, thereby heating a toner image thereon.

As illustrated in FIG. 7, the heating region H in the second example embodiment is wider than that in the first example embodiment illustrated in FIG. 5. Therefore, the secondary intermediate transfer belt 13 can be much more rapidly heated in the second example embodiment compared to the first example embodiment, resulting in reduction of energy used for heating the toner image.

Figure 8:
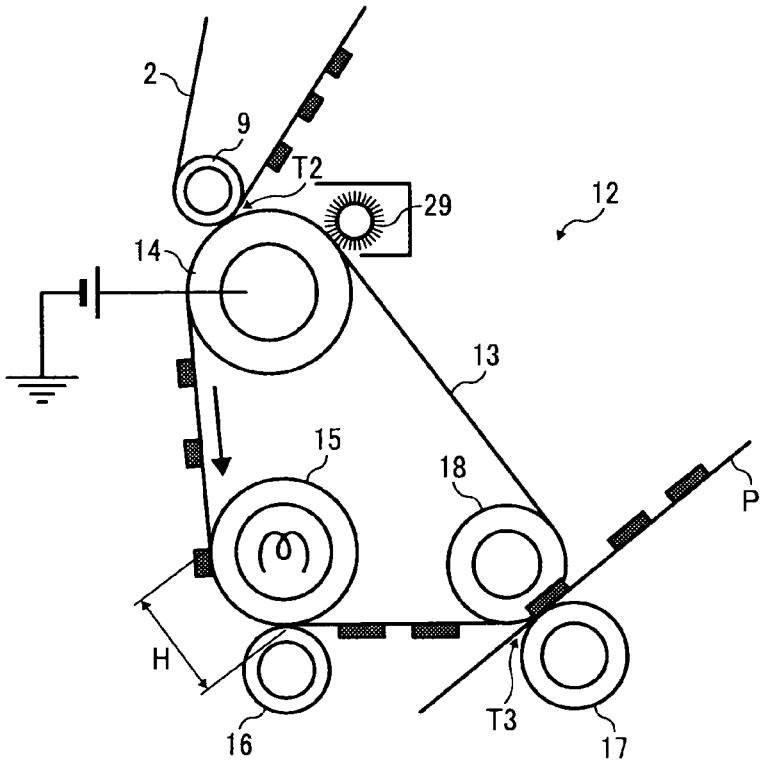
FIG. 8 is a schematic view illustrating an intermediate transfer device according to a third example embodiment.

FIG. 8 is a schematic view illustrating an intermediate transfer device according to a third example embodiment. Referring to FIG. 8, the intermediate transfer device 12 serving as a secondary intermediate transfer device is provided so as to face the driving roller 9. The secondary transfer roller 14 is provided so that the secondary transfer area T2 is formed between the intermediate transfer belt 2 and the secondary intermediate transfer belt 13.

In the third example embodiment, the heating roller 15 has a greater diameter than the deformation roller 16, thus widening an area where the secondary intermediate transfer belt 13 is in contact with the heating roller 15 (i.e., the heating region H). As a result, a larger amount of heat is applied to the toner image. Accordingly, the toner image is easily softened and efficiently deformed.

Since the secondary intermediate transfer belt 13 is thin-walled, the secondary intermediate transfer belt 13 has a high thermal conductivity, so that heat is easily transmitted to the toner image. In addition, since the secondary intermediate transfer belt 13 is flexible in shape, a less space is needed.

In order to evenly deform the toner image, the toner image is preferably deformed on a member with a smooth surface while the member preferably efficiently transmits heat to the toner image. The secondary intermediate transfer belt 13, which is thin-walled and has a high thermal conductivity, is suitably used as such a member.

Figure 9:
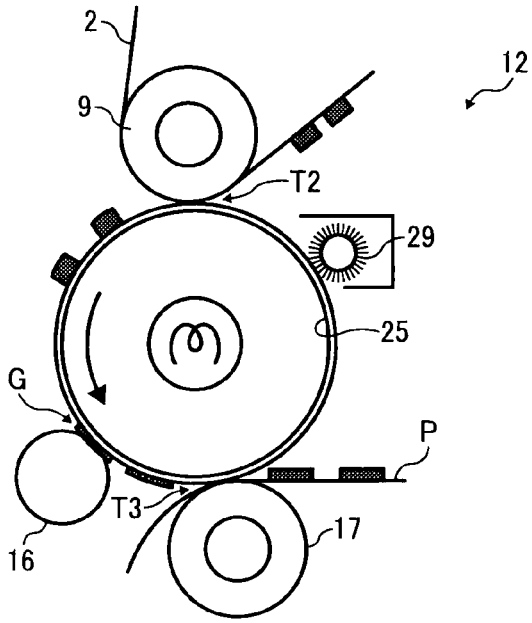
FIG. 9 is a schematic view illustrating an intermediate transfer device according to a fourth example embodiment.

FIG. 9 is a schematic view illustrating an intermediate transfer device according to a fourth example embodiment. Referring to FIG. 9, a secondary intermediate transfer roller 25, serving as a secondary intermediate transfer member that forms the toner deformation area G, is provided so as to face the driving roller 9.

In the fourth example embodiment, the secondary intermediate transfer belt 13 is replaced with the secondary intermediate transfer roller 25. The cleaning device 29 is provided in the vicinity of the secondary intermediate transfer roller 25.

The secondary intermediate transfer roller 25 is capable of stably bearing the toner image, and therefore the toner image can be evenly deformed. The secondary transfer area T2, the toner deformation area G, and the tertiary transfer area T3 can be provided around a single component of the secondary intermediate transfer roller 25, without providing any other components, resulting in reduction of cost.

In order to evenly deform the toner image, the toner image is preferably deformed on a member with a smooth surface. The secondary intermediate transfer roller 25, which has a smooth surface, is suitably used as such a member so that the toner image is evenly deformed.

The secondary intermediate transfer roller 25, which is a single component, has a plurality of functions, such as transferring the toner image from the intermediate transfer belt 2, deforming the toner image, and transferring the toner image onto the recording medium P. Therefore the number of needed components can be reduced.

The secondary intermediate transfer roller 25, which heats the toner image in the toner deformation area G, has a relatively large diameter. Therefore, the toner image receives heat from the secondary intermediate transfer roller 25 for a longer time (i.e., distance) before entering a nip formed between the secondary intermediate transfer roller 25 and the deformation roller 16.

As a time in which the toner image receives heat from the secondary intermediate transfer roller 25 lengthens, the toner image melts more quickly even if the heating temperature of the secondary intermediate transfer roller 25 is lower than a desired temperature.

Figure 10:
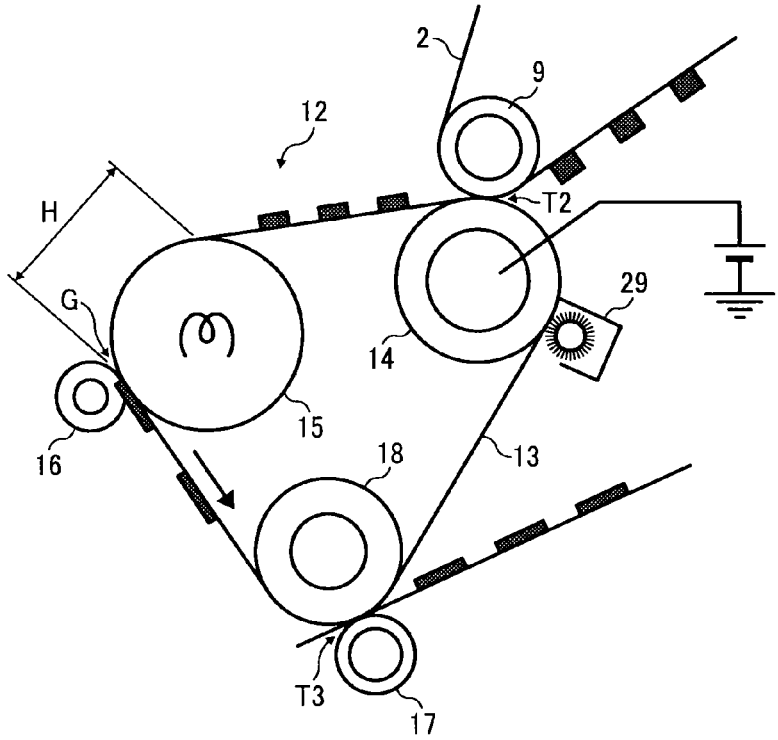
FIG. 10 is a schematic view illustrating an intermediate transfer device according to a fifth example embodiment.

FIG. 10 is a schematic view illustrating an intermediate transfer device according to a fifth example embodiment. In the fifth example embodiment, the secondary intermediate transfer belt 13 winds around the heating roller 15 forming a winding angle larger than a nip angle of the toner deformation area G.

Such a configuration widens an area where the secondary intermediate transfer belt 13 is in contact with the heating roller 15 (i.e., the heating region H). As a result, a larger amount of heat is applied to the toner image. Accordingly, the toner image is easily softened and efficiently deformed.

The larger winding angle the secondary intermediate transfer belt 13 forms with the heating roller 15, the larger area of the secondary intermediate transfer belt 13 receives heat from the heating roller 15. Accordingly, heat is easily transmitted to the toner image. The winding angle is preferably 180 degrees or more so that the heating region H is satisfactorily widened.

In order to make the winding angle 180 degrees or more, the diameter of the heating roller 15 may be increased or an additional component may be provided. In these cases, however, contradictory problems may arise, for example, too much heat might be consumed in the large-diameter heating roller 15 and the additional component might be costly. Therefore, in the present invention, the winding angle is preferably equal to or less than 180 degrees.

Figure 11:
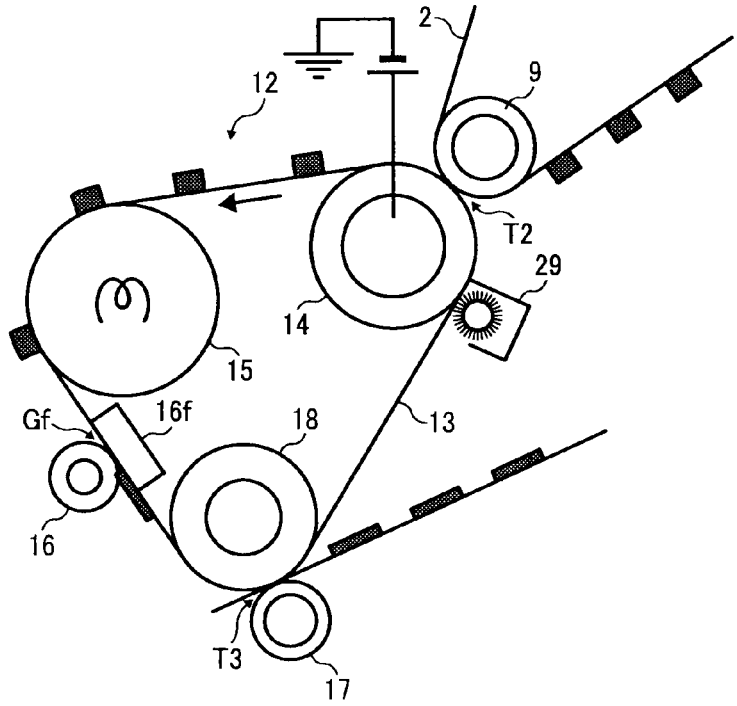
FIG. 11 is a schematic view illustrating an intermediate transfer device according to a sixth example embodiment.

FIG. 11 is a schematic view illustrating an intermediate transfer device according to a sixth example embodiment. In the sixth example embodiment, a toner deformation area Gf is formed by the deformation roller 16 and a flat member 16*f*. The toner deformation area Gf is wider than the toner deformation area G in the first to fifth example embodiments. As a result, the softened toner image is subjected to deformation for a longer time. Accordingly, the toner image is efficiently deformed.

The smaller hardness the deformation roller 16 has, the larger area the toner deformation area Gf has, resulting in much easier deformation of the toner image. Furthermore, the provision of the flat member 16*f* is effective for cooling the secondary intermediate transfer belt 13 having no toner image thereon from the backside thereof.

The deformation roller 16 and the flat member 16*f* are provided so as to face each other with the secondary intermediate transfer belt 13 therebetween. With such a configuration, the toner image is efficiently deformed.

Typically, a nip formed between a roller and a flat member is wider than that formed between two rollers. Therefore, the toner image is efficiently deformed between the deformation roller 16 and the flat member 16*f*.

Figure 12:
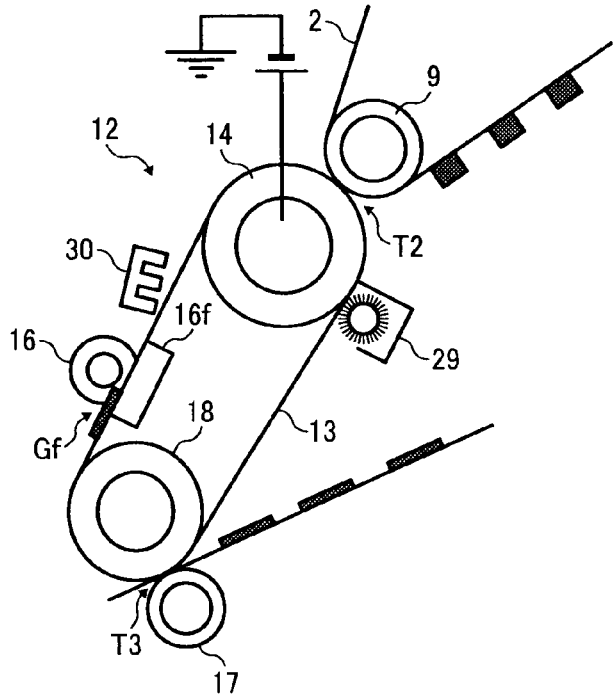
FIG. 12 is a schematic view illustrating an intermediate transfer device according to a seventh example embodiment.

FIG. 12 is a schematic view illustrating an intermediate transfer device according to a seventh example embodiment. The intermediate transfer device according to the seventh example embodiment includes the toner deformation area Gf, described in the sixth example embodiment, and the IH coil 30. With such a configuration, thermal energy needed for heating the secondary intermediate transfer belt 13 can be reduced, and the heating region H can be widened. The flat member 16*f* provides a wider toner deformation area Gf, resulting in efficient application of heat and pressure to the toner image.

Figure 13:
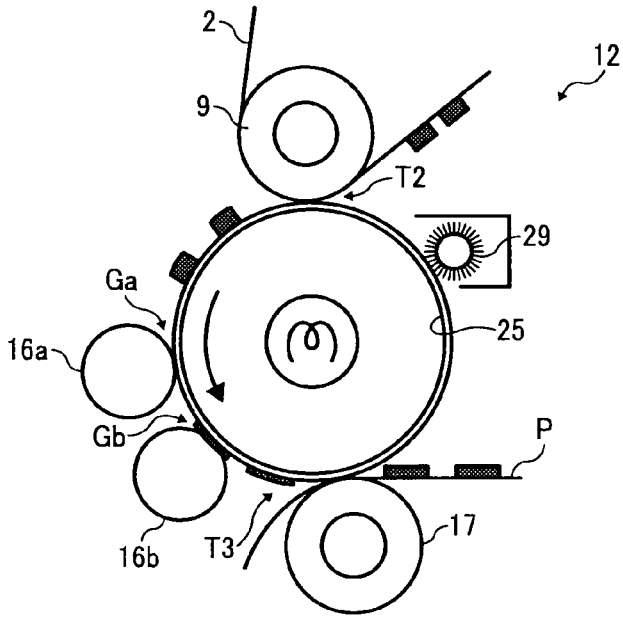
FIG. 13 is a schematic view illustrating an intermediate transfer device according to an eighth example embodiment.

FIG. 13 is a schematic view illustrating an intermediate transfer device according to an eighth example embodiment. In the eighth example embodiment, a plurality of toner deformation areas Ga and Gb are provided by a plurality of deformation rollers 16*a* and 16*b*, respectively, to efficiently deform the toner image on the secondary intermediate transfer roller 25. In a case in which the heating region H is provided on upstream from the first toner deformation area Ga, the toner image is more easily deformed.

Figure 14:
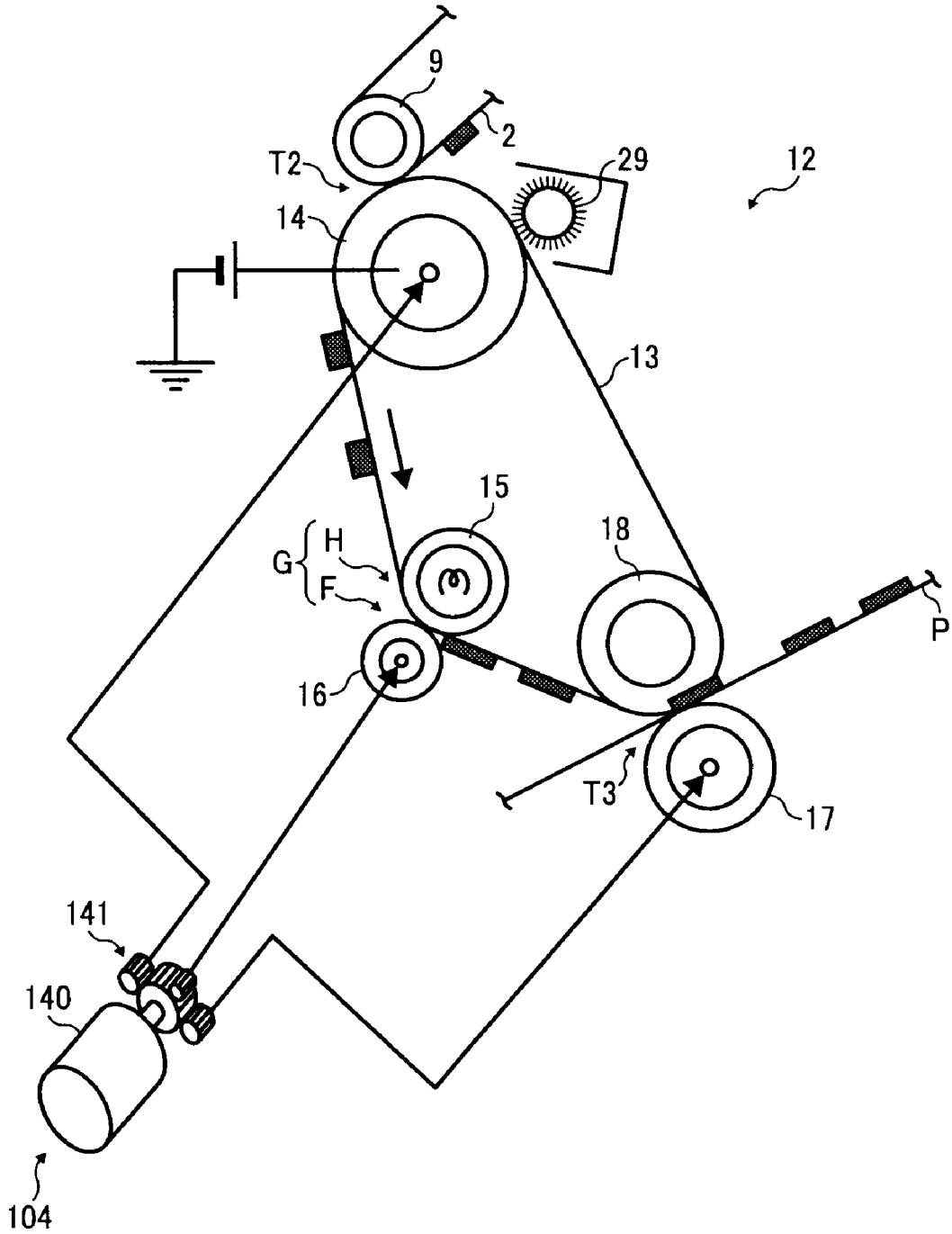
FIG. 14 is a schematic view illustrating an intermediate transfer device according to a ninth example embodiment.

FIG. 14 is a schematic view illustrating an intermediate transfer device according to a ninth example embodiment. The intermediate transfer device according to the ninth example embodiment includes a linear velocity difference providing unit 104.

The linear velocity difference providing unit 104 includes a driving source 140 and a gear train 141. The linear velocity difference providing unit 104 gives the secondary intermediate transfer belt 13 and the deformation roller 16 different linear velocities while keeping stable rotations thereof at predetermined velocities. As a result, a linear velocity difference is provided between the deformation roller 16 and the secondary intermediate transfer belt 13 having the toner image thereon, in the deformation region F. Accordingly, the toner image is easily extended when deformed on the secondary intermediate transfer belt 13.

A combination of the driving source 140 and the gear train 141 stably rotates each of the secondary intermediate transfer belt 13 and the deformation roller 16 at respective predetermined velocities, thereby providing a stable linear velocity difference therebetween. Alternatively, each of the secondary intermediate transfer belt 13 and the deformation roller 16 may be rotated at respective predetermined velocities by respective driving sources, so that a stable linear velocity difference is provided therebetween. In either case, the toner image can be stably deformed owing to the stable linear velocity difference between the secondary intermediate transfer belt 13 and the deformation roller 16. In other words, the toner image on the secondary intermediate transfer belt 13 is efficiently extended in a limited region of the deformation region F.

Figure 15:
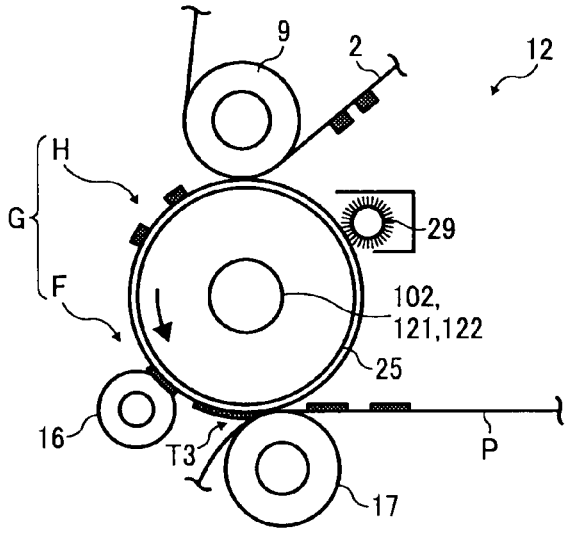
FIG. 15 is a schematic view illustrating an intermediate transfer device according to a tenth example embodiment.

FIG. 15 is a schematic view illustrating an intermediate transfer device according to a tenth example embodiment. In the tenth example embodiment, the secondary intermediate transfer belt 13 is replaced with the secondary intermediate transfer roller 25 serving as a secondary intermediate transfer member, and a heating device 102 including a heat generating device 121 including an induction heating device (i.e., an IH coil) 122 is provided inside the secondary intermediate transfer roller 25 to heat the toner image thereon.

The heating region H in the tenth example embodiment employing the secondary intermediate transfer roller 25 is wider than those in the example embodiments employing the heating roller 15. Therefore, the secondary intermediate transfer roller 25 can be much rapidly heated compared to the secondary intermediate transfer belt 13, resulting in reduction of energy used for heating the toner image.

Figure 16:
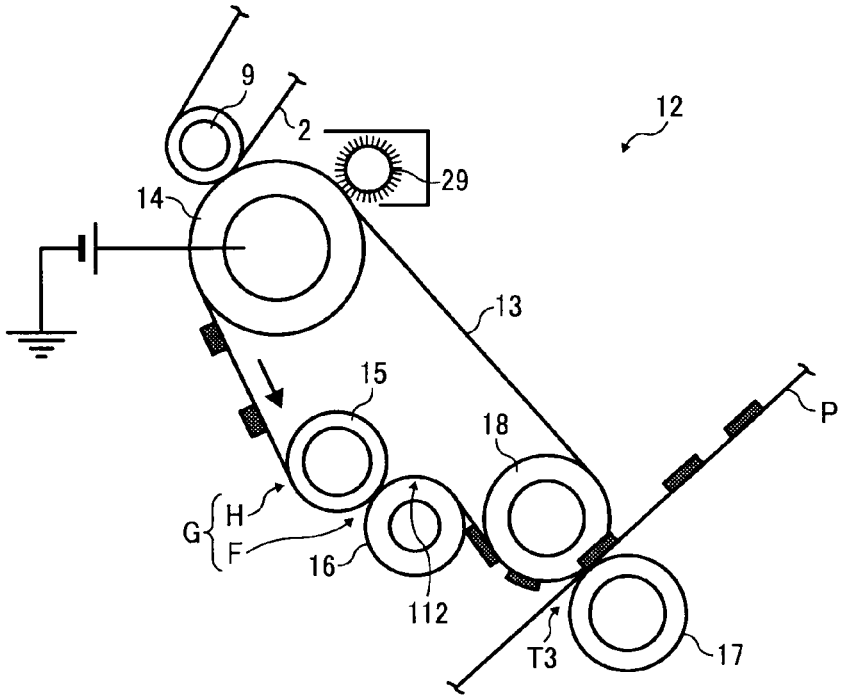
FIG. 16 is a schematic view illustrating an intermediate transfer device according to an eleventh example embodiment.

FIG. 16 is a schematic view illustrating an intermediate transfer device according to an eleventh example embodiment. In the eleventh example embodiment, a winding area 112 where the secondary intermediate transfer belt 13 contacts and winds around the deformation roller 16 is provided, in which a linear velocity difference is generated between the secondary intermediate transfer belt 13 and the deformation roller 16 due to the curvature of the winding area 112. As a result, the toner image can be stably and efficiently deformed.

Figure 17:
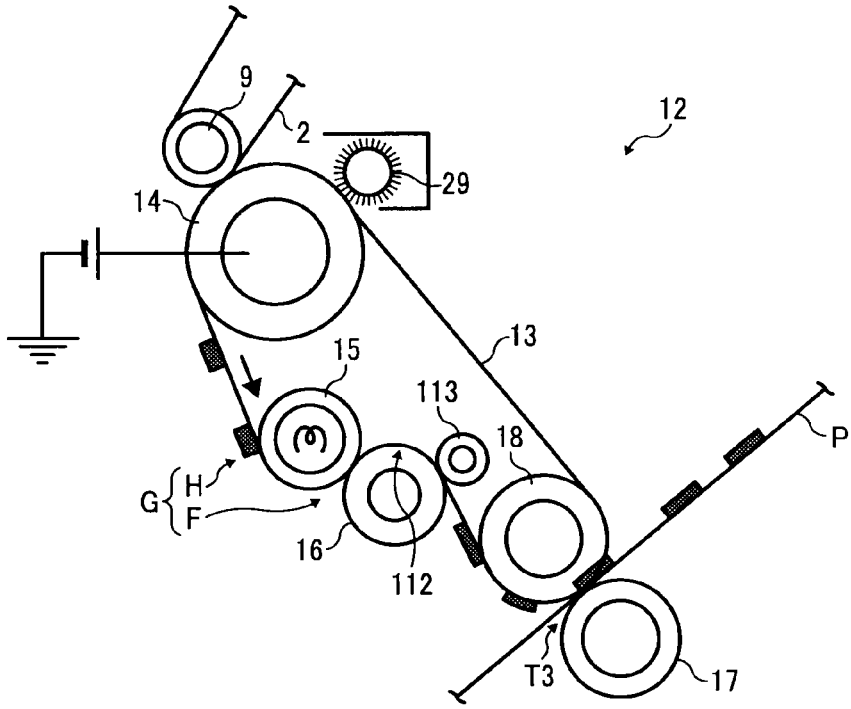
FIG. 17 is a schematic view illustrating an intermediate transfer device according to a twelfth example embodiment.

FIG. 17 is a schematic view illustrating an intermediate transfer device according to a twelfth example embodiment. In the twelfth example embodiment, a pressing member 113 is provided so as to press a downstream end of the secondary intermediate transfer belt 13 in the winding area 112 against the deformation roller 16.

In particular, the secondary intermediate transfer belt 13, including a belt-like elastic body, winds around the deformation roller 16, and the pressing member 113 is provided in the vicinity of a downstream side from the deformation region F. The pressing member 113 not only improves deformation efficiency of the toner image using a linear velocity difference, but also brings the secondary intermediate transfer belt 13 into intimate contact with the deformation roller 16. Therefore, the toner image sandwiched between the secondary intermediate transfer belt 13 and the deformation roller 16 is pressurized, resulting in reliable and even deformation of the toner image.

Figure 18:
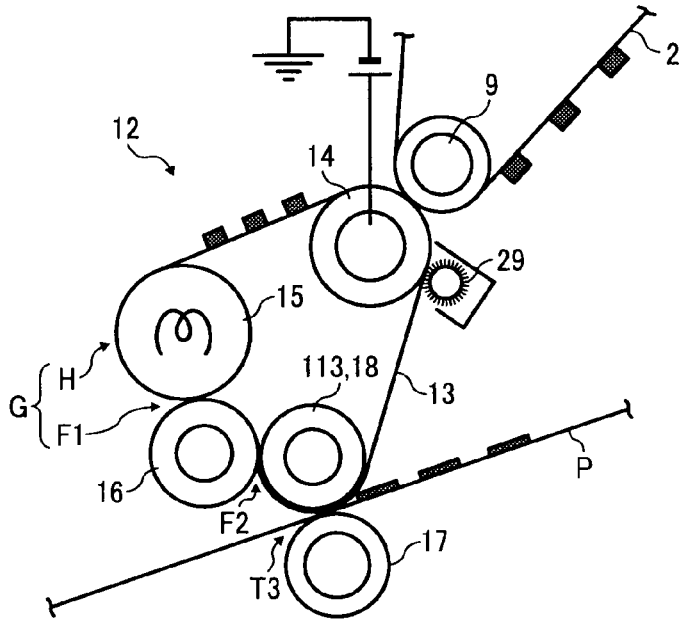
FIG. 18 is a schematic view illustrating an intermediate transfer device according to a thirteenth example embodiment.

FIG. 18 is a schematic view illustrating an intermediate transfer device according to a thirteenth example embodiment. In the thirteenth example embodiment, the pressing member 113 also serves as the tertiary transfer roller 18 configured to transfer the toner image onto the recording medium P.

In other words, the pressing member 113 has a function of the tertiary transfer roller 18 configured to transfer the toner image onto the recording medium P. Accordingly, the number of needed components can be reduced, resulting in reduction of cost. In addition, a conveyance distance and time in which the toner image is conveyed from deformation regions F1 and F2 to the tertiary transfer area T3 are shortened, thereby preventing the deformed toner image from aggregating while being conveyed.

Figure 19:
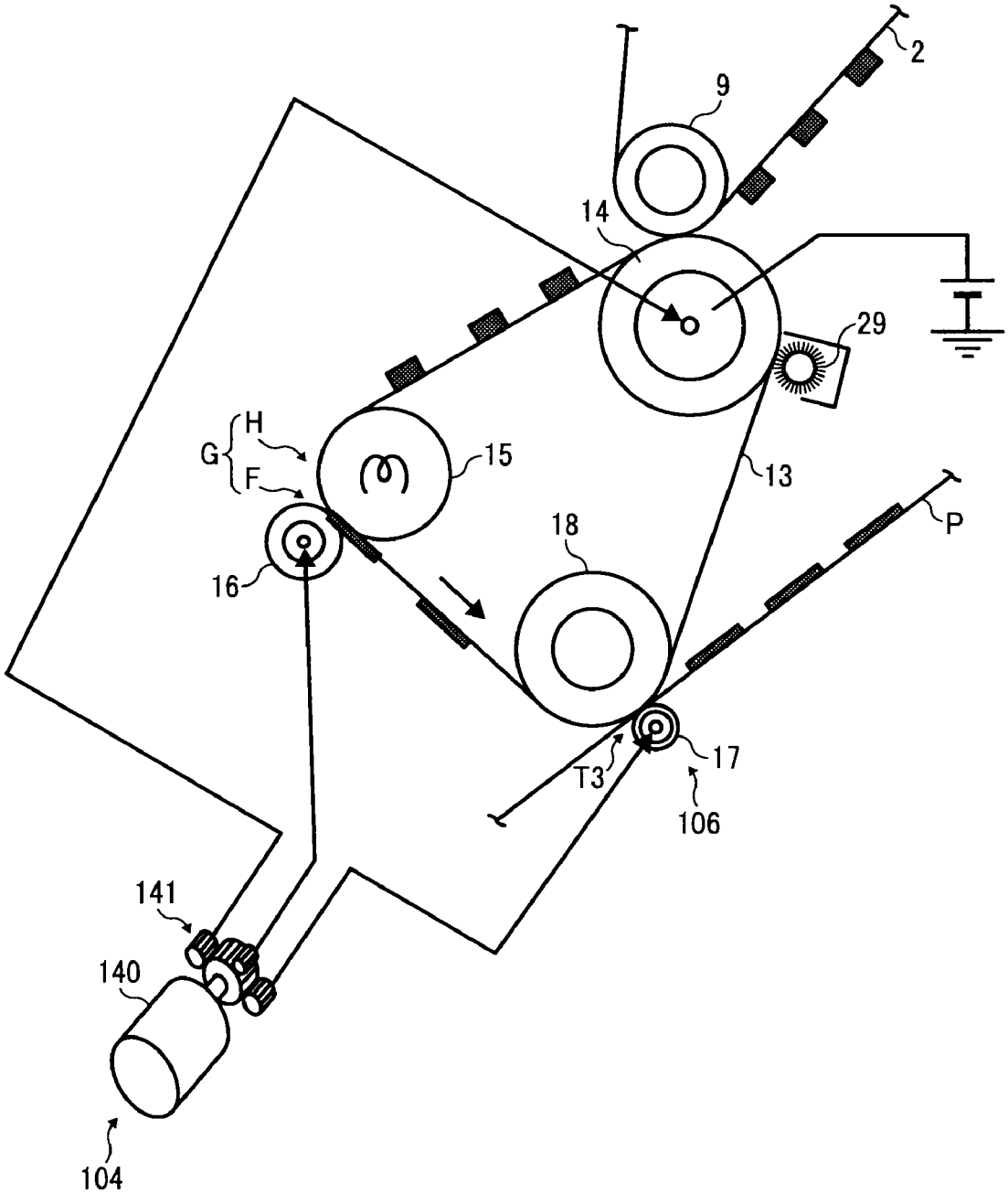
FIG. 19 is a schematic view illustrating an intermediate transfer device according to a fourteenth example embodiment.
Figure 20:
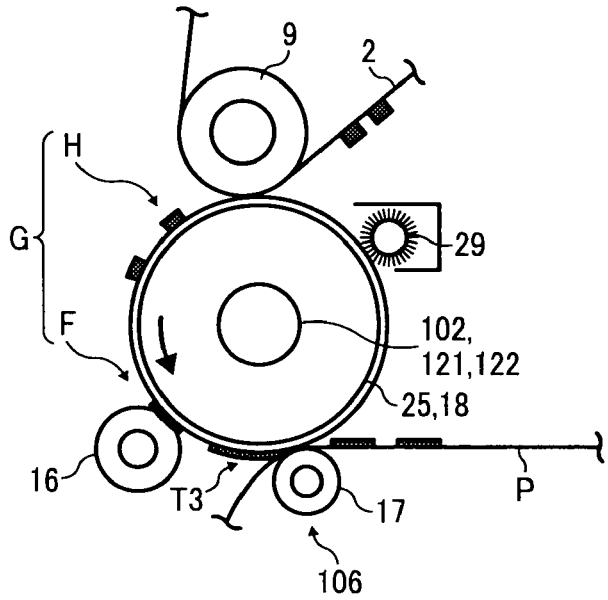
FIG. 20 is a schematic view illustrating an intermediate transfer device according to a fifteenth example embodiment.
Figure 21:
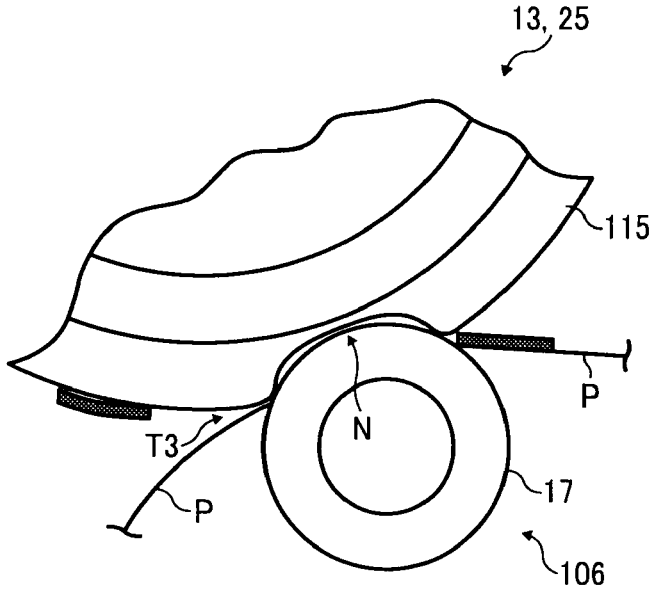
FIG. 21 is a schematic magnified view illustrating a tertiary transfer unit in the intermediate transfer devices according to the fourteenth or fifteenth example embodiments illustrated in FIG. 19 or 20.

FIG. 19 is a schematic view illustrating an intermediate transfer device according to a fourteenth example embodiment. FIG. 20 is a schematic view illustrating an intermediate transfer device according to a fifteenth example embodiment. FIG. 21 is a schematic magnified view illustrating a tertiary transfer unit in the intermediate transfer devices according to the fourteenth or fifteenth example embodiments illustrated in FIG. 19 or 20.

In FIGS. 19 to 21, a tertiary transfer unit 106 includes a pair of rollers that sandwiches and conveys the toner image on the secondary intermediate transfer belt 13 or the secondary intermediate transfer roller 25. The pair of rollers includes the tertiary transfer roller 18 (in FIG. 19) or the secondary intermediate transfer roller 25 (in FIG. 20) serving as the tertiary transfer roller 18, and the pressing roller 17.

The pressing roller 17 has a greater hardness than the secondary intermediate transfer belt 13 or the secondary intermediate transfer roller 25 (hereinafter referred to as the secondary intermediate transfer member 13 or 25), and a smaller diameter than curvature of the intermediate transfer member 13 or 25.

The pressing roller 17 is stably rotated at a predetermined velocity by the driving source 140 included in the linear velocity difference providing unit 104 via the gear train 141, thereby providing a linear velocity difference between the pressing roller 17 and the secondary intermediate transfer member 13 or 25. The pressing roller 17 has a smaller linear velocity than the deformation region F on the deformation roller 16, and the secondary intermediate transfer member 13 or 25 having the toner image thereon.

As illustrated in FIG. 21, the secondary intermediate transfer member 13 or 25 may have a multilayer structure, and an outermost elastic layer 115 may have a surface hardness of HU 1.0 N/mm$^2$ or less at an indentation depth of 20 μm.

In the tertiary transfer area T3, the pressing roller 17 has a greater hardness and a smaller diameter than the secondary intermediate member 13 or 25.

The pressing roller 17 impresses the elastic layer 115 of the secondary intermediate transfer member 13 or 25 to form a nip N therebetween. In the tertiary transfer area T3, the pressing roller 17 has a larger curvature (i.e., a smaller diameter) than the secondary intermediate transfer member 13 or 25. Owing to the difference in curvature, the recording medium P and the toner image thereon are separated from the secondary intermediate transfer member 13 or 25 after passing through the nip N. Accordingly, the toner image is easily released from the secondary intermediate transfer member 13 or 25 and transferred onto the recording medium P.

A linear velocity difference is provided between the pressing roller 17 and the secondary intermediate transfer member 13 or 25. Therefore, the toner image is easily released from the secondary intermediate transfer member 13 or 25 in the tertiary transfer area T3 and transferred onto the recording medium P.

A linear velocity difference is also provided between the deformation roller 16 and the secondary intermediate transfer member 13 or 25. Therefore, deformation and transfer efficiencies and separability of the toner image increase, while the toner image may be excessively extended.

If the toner image is excessively extended, the pressing roller 17 may have a smaller linear velocity than the secondary intermediate transfer member 13 or 25. Therefore, the excessively extended toner image is compressed to restore it to its previous state. Accordingly, the toner image is transferred onto the recording medium P without causing image distortion.

Alternatively, one of linear velocity differences between the secondary intermediate transfer member 13 or 25 and the deformation roller 16, and between the secondary intermediate transfer member 13 or 25 and the pressing roller 17, may be positive and another may be negative. In other words, when a linear velocity difference between the secondary intermediate transfer member 13 or 25 and the pressing roller 17 acts on a reverse direction to a direction in which the toner image is extended, the toner image is transferred onto the recording medium P without causing image distortion.

It should be noted that the toner image transferred onto the secondary intermediate transfer member 13 or 25 includes a toner including a wax. The toner including a wax easily transmits heat, thereby easily deforming the toner image. Therefore, the toner image can be melted with a small amount of heat. Moreover, the toner including a wax can also be easily deformed by application of pressure, and therefore the toner image on the secondary intermediate transfer member 13 or 25 can be efficiently deformed.

Accordingly, heat is easily transmitted to the toner image on the secondary intermediate transfer member 13 or 25 in the toner deformation area G. The toner image is easily deformed and released from the secondary intermediate transfer member 13 or 25.

According to the example embodiments, the toner image transferred onto the recording medium P is efficiently extended so that the toner image evenly deforms. As a result, a high quality toner image can be produced. Furthermore, the intermediate transfer devices according to the example embodiments have durability without adversely affecting neighboring devices and causing offset problems in which the toner image adheres to heated members. Moreover, the intermediate transfer devices according to the example embodiments consume a small amount of heat and save both resources and cost.

Having now fully described the invention, it will be apparent to one of ordinary skill in the art that many changes and modifications can be made thereto without departing from the spirit and scope of the invention as set forth therein.

What is claimed is:

1. An intermediate transfer device, comprising:

a secondary intermediate transfer member configured to transfer a toner image from an image bearing member via a primary intermediate transfer member and to thereafter transfer the toner image onto a recording medium;

a heating unit configured to heat the toner image on the secondary intermediate transfer member; and a deformation unit configured to deform the toner image on the secondary intermediate transfer member by application of pressure before the transfer of the toner image onto the recording medium, wherein a heating region in which the heating unit heats the toner image has a larger area than a deformation region in which the deformation unit deforms the toner image, the deformation region provided on a downstream side from the heating region relative to a direction of movement of the secondary intermediate transfer member, and wherein the heating unit has a larger diameter than the deformation unit.

2. The intermediate transfer device according to claim 1, wherein the secondary intermediate transfer member comprises a belt tightly stretched with a plurality of rollers comprising a heating roller, wherein the belt contacts the deformation unit forming a deformation angle to form the deformation region and winds around the heating roller forming a winding angle larger than the deformation angle.

3. The intermediate transfer device according to claim 2, wherein the winding angle is equal to or less than 180 degrees.

4. The intermediate transfer device according to claim 1, wherein the deformation unit comprises a non-rotatable flat member facing the secondary intermediate transfer member.

5. The intermediate transfer device according to claim 1, wherein the deformation unit is configured as a plurality of deformation units.

6. The intermediate transfer device according to claim 1, wherein a surface layer of the secondary intermediate transfer member has a surface hardness of HU 1.0 N/mm$^2$ or less at an indentation depth of 20 μm.

7. The intermediate transfer device according to claim 1, wherein the deformation unit has a higher surface hardness than the secondary intermediate transfer member.

8. An intermediate transfer device, comprising:

a secondary intermediate transfer member configured to transfer a toner image from an image bearing member via a primary intermediate transfer member and to thereafter transfer the toner image onto a recording medium;

a heating unit configured to heat the toner image on the secondary intermediate transfer member on an opposite side of the secondary intermediate transfer member as the toner image; and a deformation unit configured to deform the toner image on the secondary intermediate transfer member by application of pressure, wherein the secondary intermediate transfer member comprises a rotatable member comprising the heating unit, the rotatable member provided facing the deformation unit, wherein the rotatable member has a larger diameter than the deformation unit, and wherein the secondary intermediate transfer member contacts the recording medium downstream of the deformation unit.

9. The intermediate transfer device according to claim 8, wherein the secondary intermediate transfer member comprises a roller.

10. The intermediate transfer device according to claim 8, wherein the secondary intermediate transfer member comprises a belt.

11. The intermediate transfer device according to claim 8, wherein the deformation unit does not contact the recording medium.

12. An image forming apparatus, comprising:

an image bearing member configured to bear an electrostatic latent image;

an electrostatic latent image forming device configured to form the electrostatic latent image on the image bearing member;

a developing device configured to develop the electrostatic latent image with a toner to form a toner image;

an intermediate transfer device comprising:

an intermediate transfer member configured to transfer the toner image from the image bearing member and to thereafter transfer the toner image onto a recording medium;

a heating unit configured to heat the toner image on the intermediate transfer member; and a deformation unit configured to deform the toner image on the intermediate transfer member by application of pressure before the transfer of the toner image onto the recording medium; and a fixing device configured to fix the toner image on the recording medium, wherein a heating region in which the heating unit heats the toner image has a larger area than a deformation region in which the deformation unit deforms the toner image, the deformation region provided on a downstream side from the heating region relative to a direction of movement of the intermediate transfer member, and wherein the heating unit has a larger diameter than the deformation unit.

13. The image forming apparatus according to claim 12, wherein the toner image comprises a plurality of different-color toner images superimposed on one another on the intermediate transfer member.

14. An image forming apparatus, comprising:

an image bearing member configured to bear an electrostatic latent image;

an electrostatic latent image forming device configured to form the electrostatic latent image on the image bearing member;

a developing device configured to develop the electrostatic latent image with a toner to form a toner image;

a primary intermediate transfer device comprising a primary intermediate transfer member configured to primarily transfer the toner image from the image bearing member;

a secondary intermediate transfer device comprising:

a secondary intermediate transfer member configured to secondarily transfer the toner image from the primary intermediate transfer member and to thereafter tertiarily transfer the toner image onto a recording medium;

a heating unit configured to heat the toner image on the secondary intermediate transfer member; and a deformation unit configured to deform the toner image on the secondary intermediate transfer member by application of pressure before the transfer of the toner image onto the recording medium; and a fixing device configured to fix the toner image on the recording medium, wherein a heating region in which the heating unit heats the toner image has a larger area than a deformation region in which the deformation unit deforms the toner image, the deformation region provided on a downstream side from the heating region relative to a direction of movement of the secondary intermediate transfer member, and wherein the heating unit has a larger diameter than the deformation unit.

15. The image forming apparatus according to claim 14, wherein the toner image comprises a plurality of different-color toner images superimposed on one another on the primary intermediate transfer member.

* * * * *